United States Patent [19]

Austin

[11] 4,231,509

[45] Nov. 4, 1980

[54] PACKAGE AND BLANK THEREFOR

[75] Inventor: John J. Austin, Hinsdale, Ill.

[73] Assignee: Champion International Corporation, Stamford, Conn.

[21] Appl. No.: 37,432

[22] Filed: May 9, 1979

[51] Int. Cl.[3] ..... B65D 5/00; B65D 5/42

[52] U.S. Cl. ..... 229/22; 229/8

[58] Field of Search ..... 229/22, 8, 37 R

[56] References Cited

U.S. PATENT DOCUMENTS

| | | | |
|---|---|---|---|
| 1,978,396 | 10/1934 | Andavamis et al. | 229/22 UX |
| 3,044,211 | 7/1962 | Palm | 229/8 UX |
| 3,185,378 | 5/1965 | Rosemburg, Jr. | 229/22 |
| 3,194,473 | 7/1965 | Rumberger | 229/37 R |
| 3,397,771 | 8/1968 | Fogle | 229/22 R X |
| 3,653,576 | 4/1972 | Stramicky | 229/22 |
| 3,880,342 | 4/1975 | Longo, Jr. | 229/22 X |
| 3,884,352 | 5/1975 | Pilz | 229/22 |

*Primary Examiner*—Davis T. Moorhead
*Attorney, Agent, or Firm*—Evelyn M. Sommer

[57] ABSTRACT

A sheet-material blank is disclosed and a package which is made by folding of the blank. The package has two hollow tubular sections of triangular cross-section with the apices of the triangles being connected. The ends of the sections are closed by end walls formed by tabs of the blank.

4 Claims, 6 Drawing Figures

PACKAGE AND BLANK THEREFOR

BACKGROUND OF THE INVENTION

This invention relates to a package and to a blank for making the same.

More particularly, the invention relates to a package for small articles, for example capsules, tablets or the like, and to a blank from which the package can be erected.

Packages of many different kinds and types are known, for packaging most every conceivable commodity. However, the prior art packages are not always too well suited for certain applications, be it because of difficulties in constructing the package, problems with introducing the contents into the package, a lack of content accessibility later on, or for other reasons.

SUMMARY OF THE INVENTION

It is an object of the invention to overcome the prior-art drawbacks.

A more particular object is to provide a novel package which is especially well suited for packaging of small objects, and a blank for erecting such a package.

Pursuant to these and still further objects one aspect of the invention resides in a package comprising an elongated sheet material body having two parallel longitudinal edges and two parallel transverse edges and fold lines subdividing the body into a plurality of sections arranged side-by-side along the length of the body and each having two ends which are respectively located at the parallel longitudinal edges, and a gluing strip extending along one of the transverse edges; an end closure tab extending from each of the sections at one of the longitudinal edges; and an end closure tab extending from each of at least two adjacent ones of the sections at the other of the longitudinal edges.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
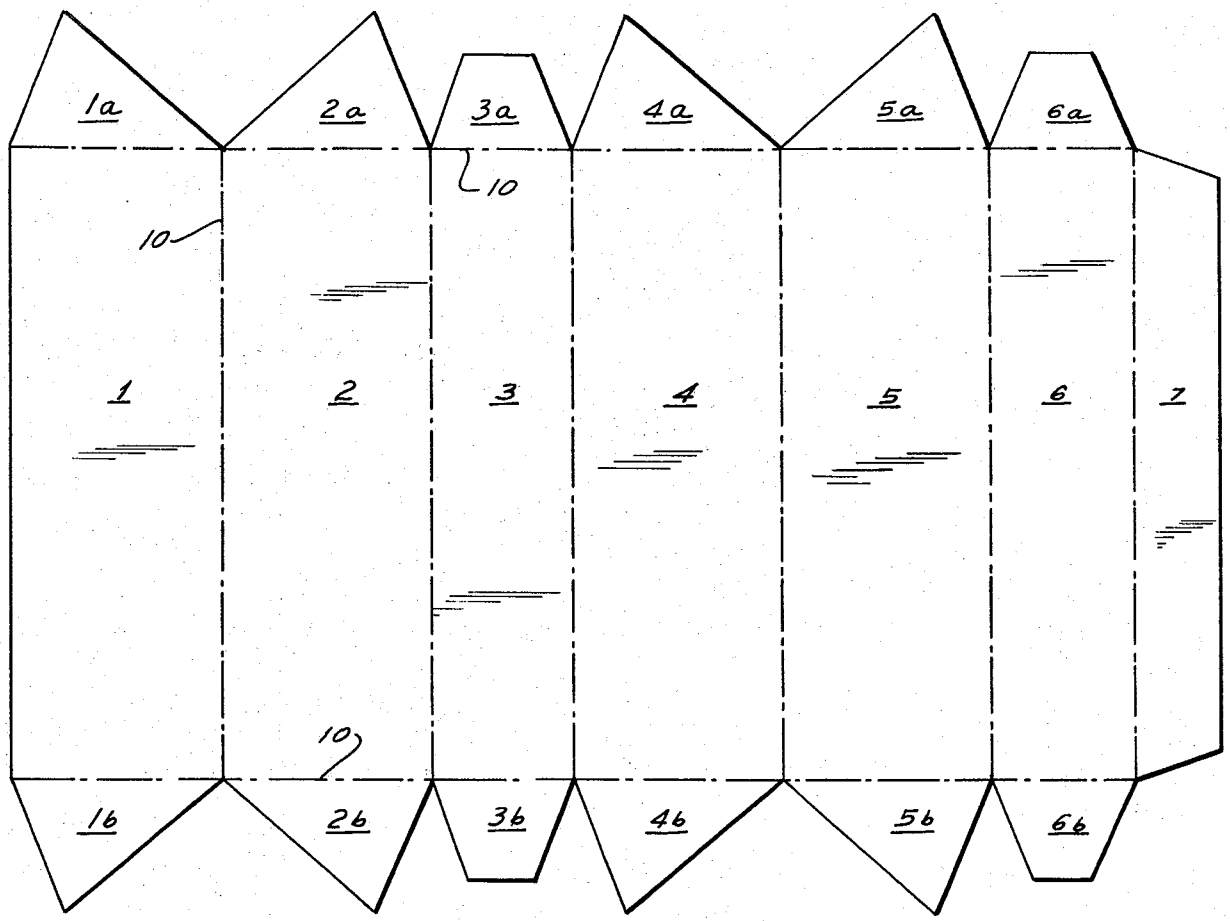
FIG. 1 is a plan view of a blank for erecting a package according to the invention.
Figure 2:
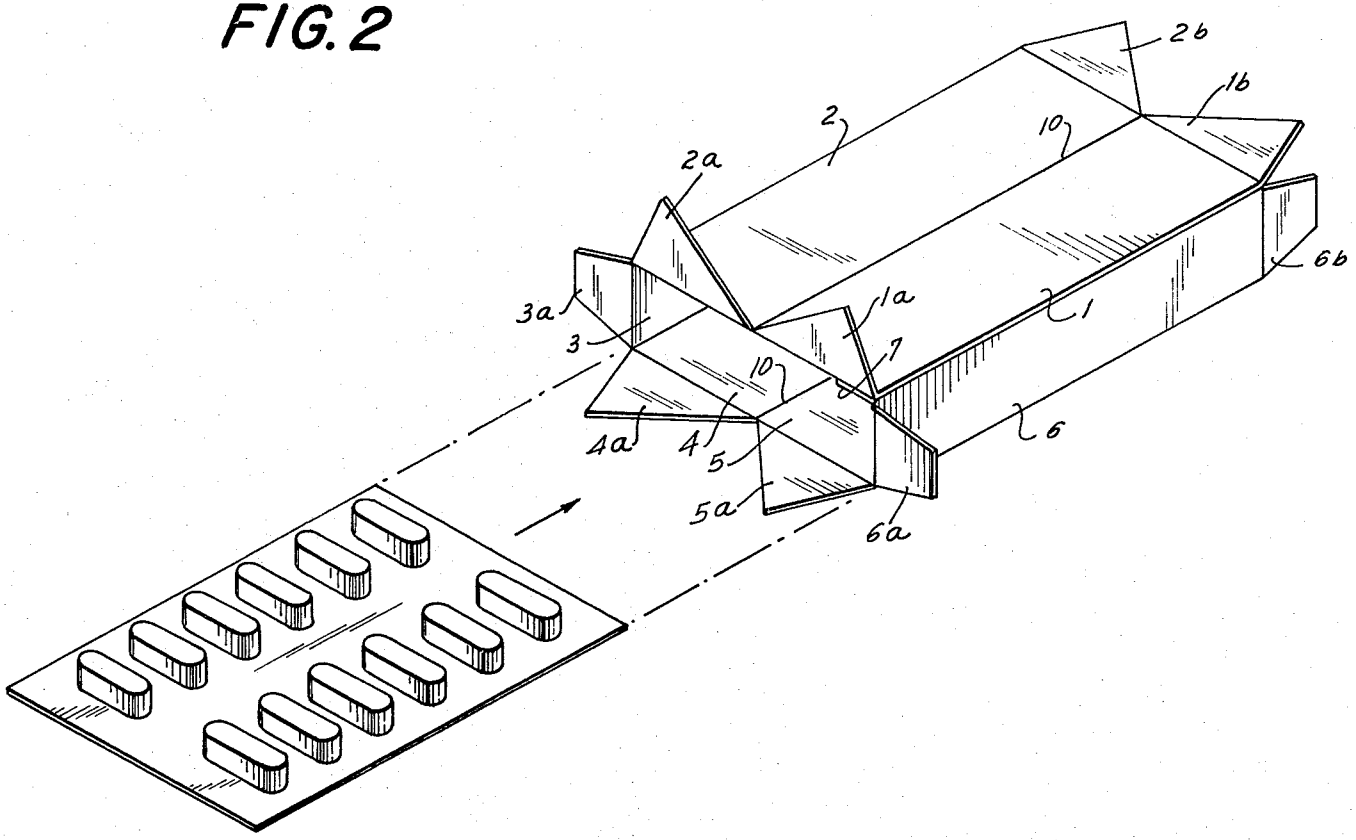
FIG. 2 is an endview of a partially erected package made from the blank in FIG. 1.
Figure 3:
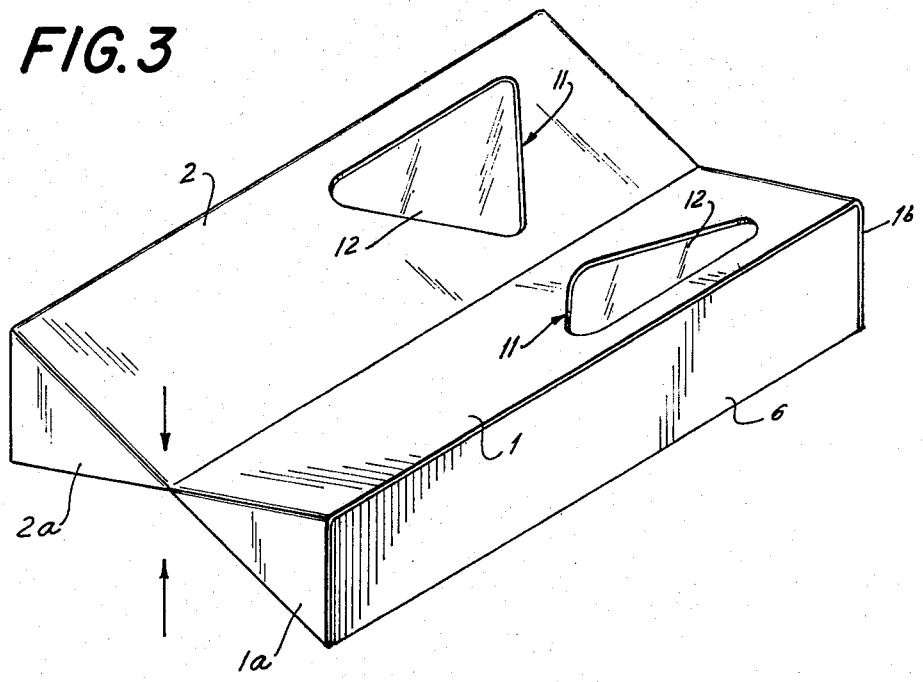
FIG. 3 is a perspective view showing a package resembling the one in FIG. 2 but in completely erected condition.

A first embodiment of the invention is illustrated in FIGS. 1–3, wherein FIG. 1 shows a blank for a package, FIG. 2 the blank in semi-erected form, and FIG. 3 the finished package. It should be noted, however, that FIG. 3 includes a slight modification which will be explained subsequently.

The blank in FIG. 1 may be made of cardboard stock, synthetic plastic sheet material of requisite structural strength, or any other material conventionally used for making erectable packages. It has a blank body composed of the illustrated, sequentially arranged sections 1, 2, 3, 4, 5 and 6. Adjacent the section 6 is a glue flap 7. The opposite ends of the elongated sections 1–6 are provided with tabs 1*a*, 1*b*; 2*a*, 2*b* . . . 6*a*, 6*b*, of the illustrated shapes. Along the junctions of the sections 1–6, and along the junctions of the tabs to their respective sections, are provided score lines 10.

To erect the blank of FIG. 1 into the package shown in FIG. 3, the sections 3 and 6 are erected to form sidewalls (FIG. 2) between which the sections 4 and 5 form a bottom wall. The sections 1 and 2 are then folded over from the sections 3 to the section 6 and the glue flap 7 is folded beneath the edge portion of section 1 which has now become located next to section 6. The glue flap 7 is, of course, provided at this time or at some prior time with glue on that one of its surfaces which, in the position of FIG. 2, faces upwardly towards the section 1 (the glue could, instead, be provided on the underside of section 1 along the edge which will overlie the glue flap 7).

The objects to be packaged are now inserted through one of the open ends into the semi-erected package. The package is particularly well suited for small articles (e.g., medication capsules or tablets) which are carded on a blister package as shown in FIG. 2.

Once the contents have been inserted, pressure is exerted upon the semi-finished package from the top and/or bottom, substantially at the score lines 10 separating the sections 1, 2 and/or 4, 5, so that these two score lines 10 move towards one another. The tabs 3*a* and 6*a* are then folded inwardly, followed by the tabs 4*a*, 5*a* which are folded upwardly whereupon the tabs 1*a*, 2*a* are folded downwardly to overlie the outer sides of the tabs 4*a*, 5*a* to which they are then glued. The same procedure is followed at the other end with the tabs 1*b*–6*b* and the package is finished.

If desired, cut-outs may be provided in any of the sections 1–6, and may be either left open (especially if the contents of the package are carded and blister-packed) or a transparent foil (e.g., cellaphone, PVC, PET) may be placed behind them and suitably bonded to the respective section. Thus, ready viewing of the package contents is assured. This is the modification illustrated in FIG. 3, where the cut-outs 11 have transparent plastic foil 12 behind them. Of course, the entire package may be made of transparent material (e.g., semi-rigid polyethylene or the like).

Figure 5:
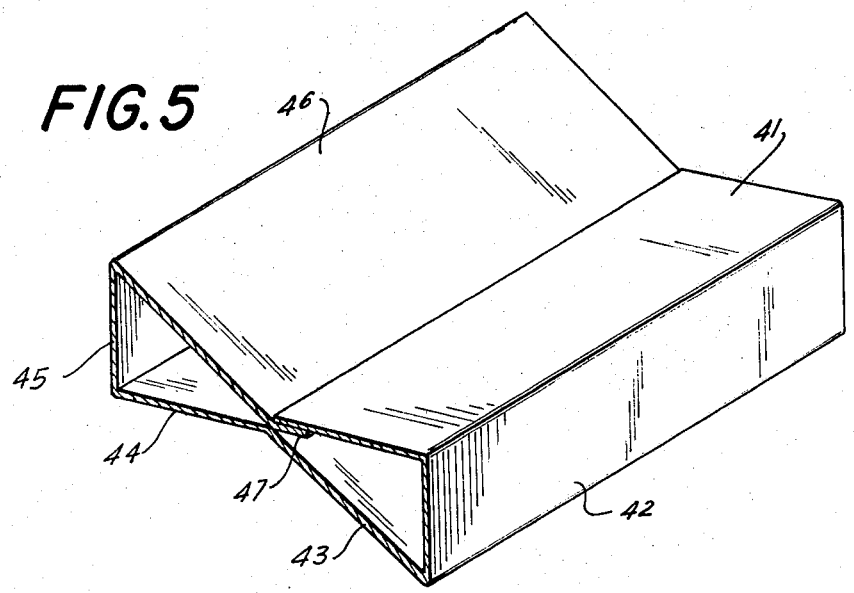
FIG. 5 is an end view of a partially erected package made from the blank in FIG. 4.
Figure 4:
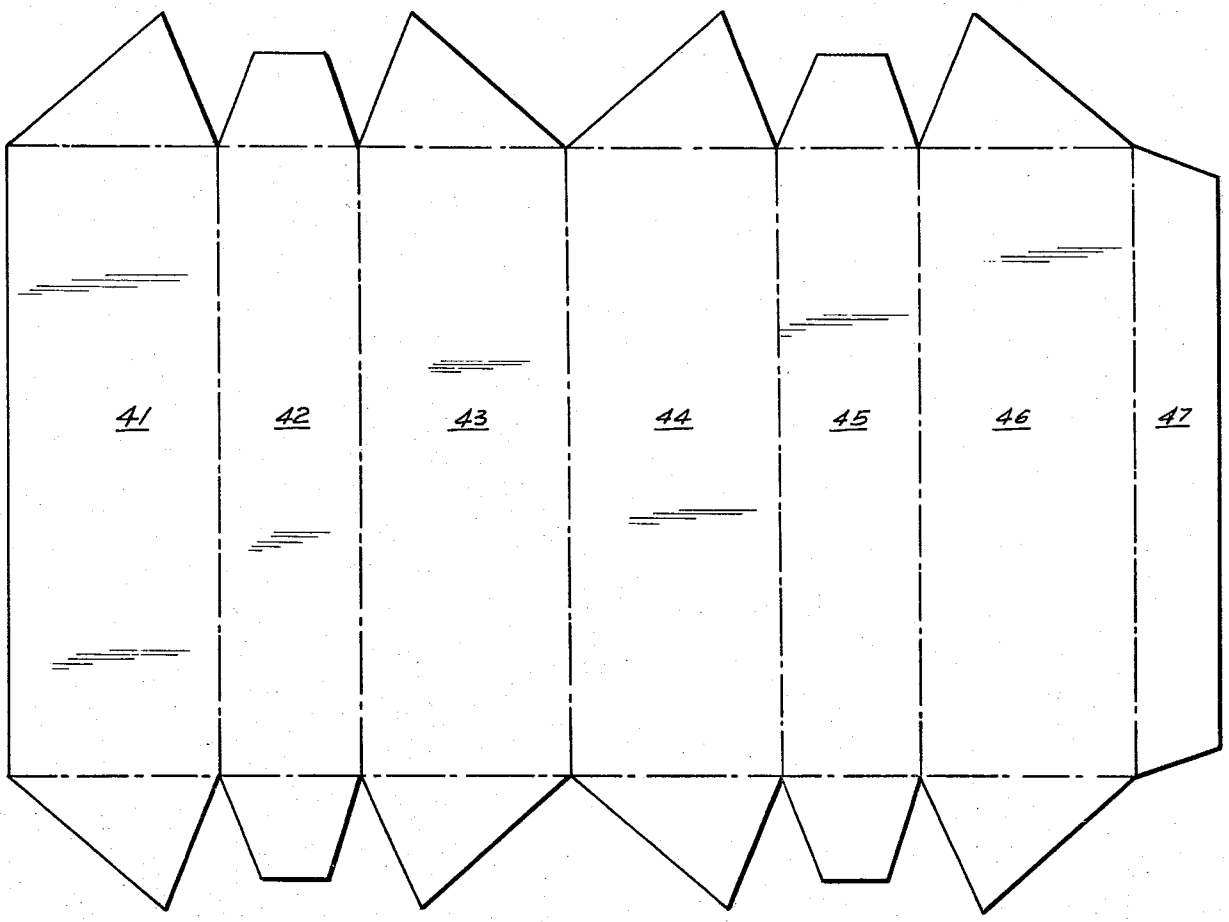
FIG. 4 is a plan view of a blank according to another embodiment.

The embodiment in FIGS. 4 and 5 differs from the preceding one in the location of the glue flap on the finished package.

The blank in FIG. 4 is again provided with six blank sections 41–46 and with a glue flap 47. The sequence of wider (42, 43, 45, 46) and narrower (42, 45) sections is, however, different from the embodiment in FIGS. 1–3, as a comparison of FIG. 4 with FIG. 1 will readily show. Putting it differently: the embodiment in FIG. 4 would be obtained by placing the glue flap 7 of FIG. 1 alongside the body section 1, instead of alongside the section 6.

The result in this difference is that on erection of the blank into the package the glue flap 47 abuts and is glued to e.g., the inner surface of section 44 (shown) or else the inner surface of section 44. The erection itself, as well as the insertion of articles in the package, proceeds in the manner described with respect to the first embodiment. In both instances the erection, loading and closing of the package can be accomplished by available packaging machines, preferably with the package in horizontal orientation.

Figure 6:
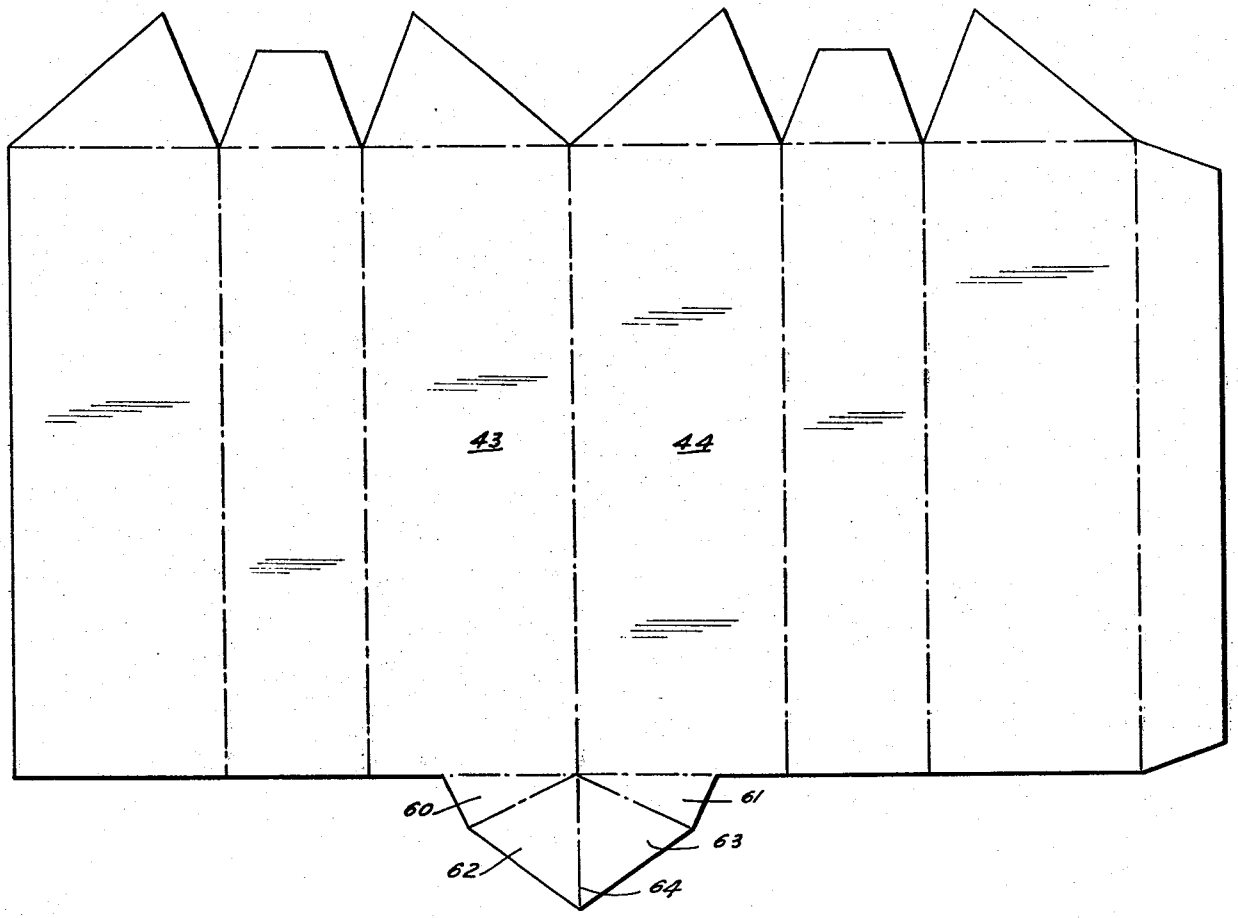
FIG. 6 is a plan view of a blank according to still a further embodiment.

A blank for the erection of a package permitting viewing of the contents through one end of the package, is shown in FIG. 6. This blank resembles the one in FIG. 4, but along one edge of the main body the tabs are omitted, except that modified tabs 60, 62 are provided on the section 43 and similar tabs 61, 63 are provided on the section 44. The tabs 60, 62 are separated from the tabs 63, 61 by a cut 64, as shown. When this blank is erected the finished package will have one fully closed end as in the other embodiments, and one end which is only partially closed by the tabs 60–63 (to keep the contents from falling out) so as to afford a view of the contents through this end. This end treatment may be used with any of the various blank embodiments, not only with the one shown in FIG. 4.

The disclosed invention is susceptible of various modifications which are intended to be encompassed in the protection sought. Thus it will be apparent that the glue flap may be located differently from the exemplary embodiments, and also that the package may have various dimensions, i.e., that it may be larger or smaller than the showing in the drawings. The arrangement of the body sections may also be different from what has been shown. For example, in FIG. 1 the sections 1 and 2 could be omitted from their illustrated location and could, instead, be positioned between the section 6 and the glue flap 7.

While the invention has been illustrated and described as embodied in a package, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A package for a carded blister pack including a generally planar card having two parallel rows of products secured thereto, said package comprising a single sheet folded to define two hollow sections of triangular cross-section which are connected at the apices of the respective triangles, each triangle including an upper wall portion and an identical lower wall portion, and a side wall portion extending from said upper wall portion to said lower wall portion, the upper wall portions of said triangles being inclined downwardly towards one another and towards said lower wall portions, while the latter are inclined upwardly towards one another and towards said upper wall portions, said package further including end walls closing the ends of said hollow sections whereby, with the carded blister pack disposed within the carton, each row of products is respectively disposed within a triangular hollow section.

2. A package as defined in claim 1, wherein said sheet-material body is of cardboard.

3. A package as defined in claim 1, at least one of said sections having at least one cut-out through which the contents of the package are viewable.

4. A package as defined in claim 3, further comprising a transparent film spanning said cut-out.

* * * * *

UNITED STATES PATENT AND TRADEMARK OFFICE

CERTIFICATE OF CORRECTION

PATENT NO. : 4,231,509

DATED : November 4, 1980

INVENTOR(S) : John J. Austin

It is certified that error appears in the above-identified patent and that said Letters Patent are hereby corrected as shown below:

In column 2, line 46, delete "cellaphone" and insert in lieu thereof -- cellophane --.

In column 2, line 59, delete"(42, 45)" and insert in lieu thereof -- (41, 44) --.

Signed and Sealed this

*Twenty-third* Day of *June 1981*

[SEAL]

*Attest:*

RENE D. TEGTMEYER

*Attesting Officer*

*Acting Commissioner of Patents and Trademarks*